US006299355B1

(12) United States Patent
Schneck

(10) Patent No.: US 6,299,355 B1
(45) Date of Patent: Oct. 9, 2001

(54) RECLOSEABLE EASY-OPEN INDUSTRIAL BAG AND TAB FOR USE THEREWITH

(76) Inventor: Gene Douglas Schneck, 703 Stanley Ave., Rockingham, NC (US) 28379

( * ) Notice: Subject to any disclaimer, the term of this patent is extended or adjusted under 35 U.S.C. 154(b) by 0 days.

(21) Appl. No.: 09/455,887

(22) Filed: Dec. 6, 1999

Related U.S. Application Data

(63) Continuation-in-part of application No. 09/207,091, filed on Dec. 7, 1998, and a continuation-in-part of application No. 09/241,947, filed on Feb. 2, 1999, now Pat. No. 6,241,390.

(51) Int. Cl.[7] ..... B65D 33/00

(52) U.S. Cl. ..... 383/205; 383/86; 383/203; 383/211

(58) Field of Search ..... 383/86, 89, 62, 383/203, 205, 210, 211, 85; 229/301, 80, 80.5

(56) References Cited

U.S. PATENT DOCUMENTS

| | | | | |
|---|---|---|---|---|
| Re. 22,490 | | 5/1944 | Rambold . | |
| Re. 28,317 | | 1/1975 | Goodrich . | |
| Re. 28,318 | | 1/1975 | Goodrich . | |
| 218,650 | | 8/1879 | Weaver . | |
| 220,510 | | 10/1879 | Weaver . | |
| 2,071,745 | | 2/1937 | Higginbottom . | |
| 3,074,610 | | 1/1963 | Pugh . | |
| 3,308,996 | | 3/1967 | Beck . | |
| 3,545,668 | | 12/1970 | Hultberg . | |
| 3,557,853 | * | 1/1971 | Jones | 383/86 |
| 3,565,328 | | 2/1971 | Hudson . | |
| 3,687,356 | | 8/1972 | Goodrich et al. . | |
| 4,142,667 | | 3/1979 | Runo . | |
| 4,441,613 | * | 4/1984 | Hain et al. | 383/203 |
| 4,480,752 | | 11/1984 | Jacobs . | |
| 4,483,445 | | 11/1984 | Lepisto et al. . | |
| 4,498,192 | | 2/1985 | Becker et al. . | |
| 4,512,479 | | 4/1985 | Hain et al. . | |
| 4,515,273 | | 5/1985 | Jacobson et al. . | |
| 4,557,385 | | 12/1985 | Robinson . | |
| 4,577,761 | | 3/1986 | Nadaskay . | |
| 4,638,912 | * | 1/1987 | Graf | 383/62 X |
| 4,744,466 | | 5/1988 | Hall . | |
| 4,871,265 | * | 10/1989 | Peck | 383/86 X |
| 4,946,289 | * | 8/1990 | Bolling et al. | 383/86 X |
| 4,955,981 | * | 9/1990 | Provost | 383/86 |
| 5,035,518 | * | 7/1991 | McClintock | 383/86 X |
| 5,044,776 | * | 9/1991 | Schramer et al. | 383/89 |
| 5,085,724 | | 2/1992 | Focke . | |
| 5,478,153 | | 12/1995 | Feldkämper . | |
| 5,833,368 | | 11/1998 | Kaufman . | |
| 5,855,434 | * | 1/1999 | Hagen | 383/203 X |
| 6,032,854 | * | 3/2000 | Greer et al. | 229/80 X |
| 6,048,100 | * | 4/2000 | Thrall et al. | 383/203 X |
| 6,068,403 | * | 5/2000 | Schneck | 383/205 |
| 6,120,184 | * | 9/2000 | Laurence et al. | 383/86 X |

FOREIGN PATENT DOCUMENTS

| | | |
|---|---|---|
| 634126 | 1/1962 | (CA) . |
| 675711 A5 | 10/1990 | (CH) . |
| 803 267 | 2/1951 | (DE) . |
| 546 782 | 7/1942 | (GB) . |
| 582 372 | 11/1946 | (GB) . |

* cited by examiner

*Primary Examiner*—Jes F. Pascua
(74) *Attorney, Agent, or Firm*—Marshall, Gerstein & Borun

(57) ABSTRACT

An easy open industrial bag includes a tab secured to a front wall on the exterior of the bag. The tab is secured between the front wall and a flap formed on a back wall of the bag and folded over and secured to the front wall for closing the bag. The flap is secured with an adhesive disposed in a pattern providing an adhesive void at an opening edge of the bag.

10 Claims, 10 Drawing Sheets

FIG. 12
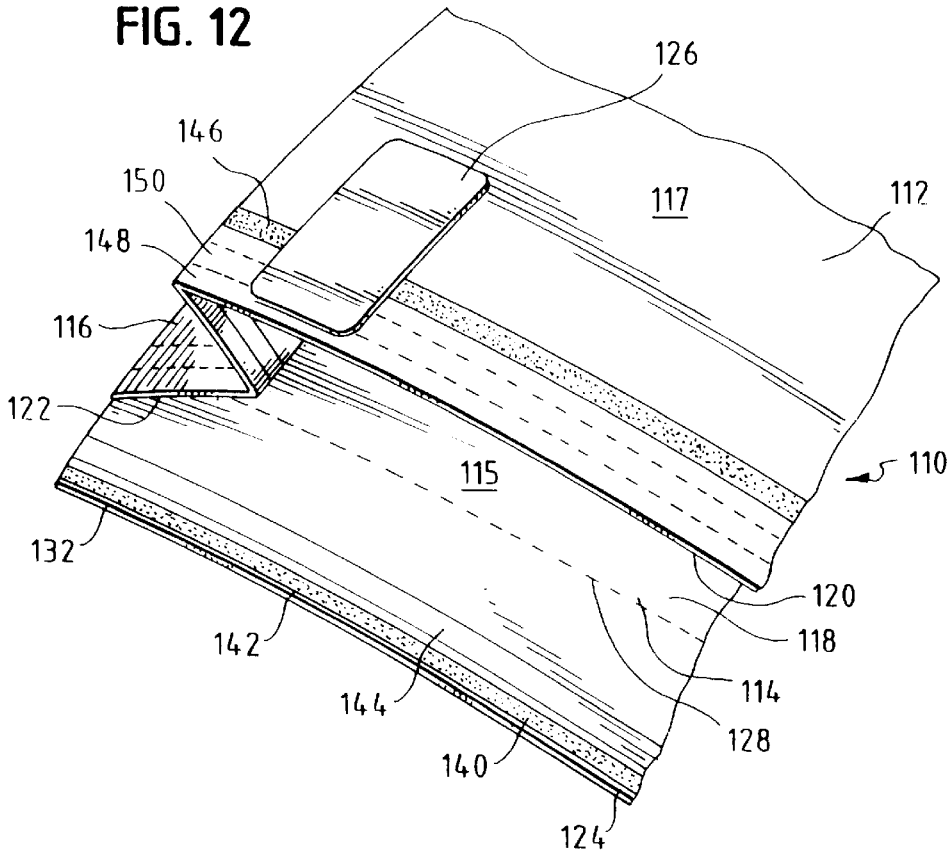
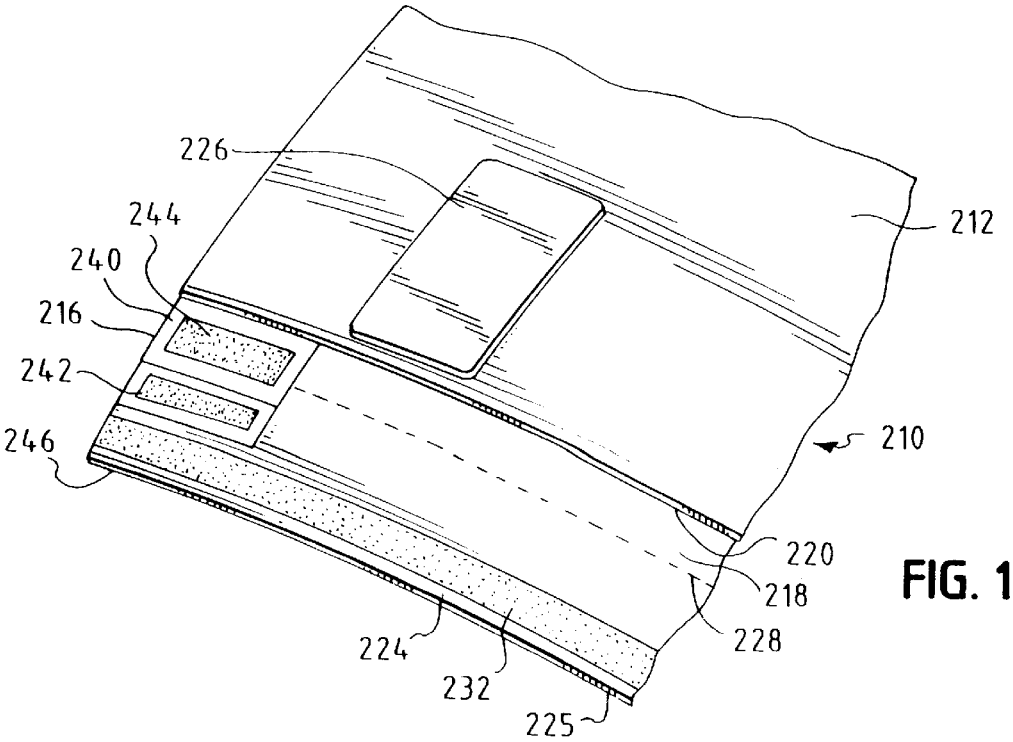
FIG. 13

RECLOSEABLE EASY-OPEN INDUSTRIAL BAG AND TAB FOR USE THEREWITH

CROSS-REFERENCE TO RELATED APPLICATIONS

This application is a continuation-in-part of U.S. patent application Ser. No. 09/207,091, filed Dec. 7, 1998, and entitled "Easy Open Industrial Bag" and is a continuation-in-part of U.S. application Ser. No. 09/241,947, filed Feb. 2, 1999, now U.S. Pat. No. 6,241,390, and entitled Recloseable Easy-Open Industrial Bag and Tab for Use Therewith."

BACKGROUND OF THE INVENTION

The invention relates generally to industrial bags and, more particularly, the invention relates to an easy-open industrial bag and tabs for use therewith.

DESCRIPTION OF THE RELATED ART

Industrial bags, often made from multi-ply kraft paper, synthetic sheets, and combinations thereof, are closed in numerous ways. A common closure is referred to as a pinch bottom where a flap of one wall of the bag is folded over and glued, sewn or otherwise secured to another wall of the bag. The pinch bottom closure is commonly used in gusseted bags and flat tube bags.

Once closed it becomes necessary at some point to open the bag. In bags that were sewn shut, it is possible to open the bag by undoing the stitching. Sewing generally requires substantial additional processing equipment and processing expense, and thus is no longer a preferred closure method. Providing a glued closure for a pinch bottom bag provides for an easily automated process that is inexpensive and yields a secure sift resistant closure. However, glued closures are difficult to open without cutting the bag, or substantially tearing the walls of the bag. The walls of the bag, of course, are designed to resist tearing, which further makes opening of the bag difficult, and cutting requires having a cutting tool to be handy.

In U.S. Pat. No. 4,480,752 there is disclosed a feature for a pinch bottom bag that facilitates the opening of the bag. The feature includes a tab which is bonded inside the bag within one of the side wall gusset folds. A portion of the tab extends out of the interior of the bag and as the bag is folded closed, remains exposed to the exterior of the bag. By pulling on the tab, the pinch bottom closure is opened in an area surrounding the tab.

In commonly-assigned U.S. Pat. application Ser. No. 08/768,389, the disclosure of which is hereby expressly incorporated herein by reference, an easy opening feature for industrial bags is also described. A tab is bonded into the bag with a portion extending outwardly from the bag, and the side walls of the bag are formed to include at least one tear line to cause localized tearing of the bag during opening as well as to reduce the effort required to open the bag. In particular embodiments of the bag, tear lines may be formed in both the front and back walls of the bag and arranged so as to align and overlap in a double fold closure.

Disposing the tab within the bag may cause difficulty when the bag is used for particular contents materials. For example, if the bag is to contain pet food, the pet food will typically have some fat content. Unless the tab is specially treated, such as coated with silicone or formed from synthetic materials, over time the tab will wick fatty oils from the pet food to the exterior of the bag. The fatty oils make the tab difficult to grasp hindering opening of the bag, may weaken the tab causing it to fail as the bag is opened, may distort printing disposed on the bag and/or the tab, and may further attract insects and rodents. Using silicone coated tabs and or synthetic materials to form the tab presents problems in effectively gluing the bag closed.

Many times it is desirable to reclose the bag after it has been opened. This is often the case where not all of the contents of the bag will be distributed. Reclosing a bag either sewn closed or glued closed is generally not possible without the use of tape or a clip to keep the bag closed. Frequently neither tape nor a clip is available and the bag is simply folded over in the hope that it will remain closed and that its contents will not spill.

SUMMARY OF THE INVENTION

The invention provides an easy open feature for an industrial bag utilizing a tab disposed on the exterior of the bag in combination with a uniquely glued closure.

In accordance with a preferred embodiment of the invention, a bag includes a front wall, a back wall, first and second side walls interconnecting the front wall and the back wall, and an enclosed end defining an interior portion and an exterior portion of the bag. The enclosed end includes a flap formed integral with the back wall that is folded over and bonded to the front wall using adhesive. A tab is secured to the front wall on the exterior of the bag and is disposed between the flap and the front wall. The tab is detachably secured to the front wall and the adhesive is disposed between the front wall and the flap in a pattern defining an adhesive void adjacent an opening edge of the bag.

In accordance with another aspect of the invention, a tab useful in opening the bag is further useful for reclosing the bag. The tab may include a peel-free adhesive that permits the tab to be repeatably reattached to an outer surface of the bag. A opening flap of the bag may then be folded over to close the opening and the tab used to keep the bag in the closed condition.

Alternatively, the tab may include a segmented backing material. Removing successive portions of the segmented backing material exposes adhesive. The bag may be folded closed and the exposed adhesive used to keep the bag closed. As the exposed portion of adhesive becomes less effective for keeping the bag closed, another segment of the backing material may be removed exposing fresh adhesive.

BRIEF DESCRIPTION OF THE DRAWINGS

These and other advantages and features of the invention will become apparent to one of ordinary skill in the bag making art from the following detailed description of several preferred embodiments of the present invention with reference to the attached drawings wherein like reference numerals are used to identify like elements throughout and in which:

FIG. 12 is a partial perspective view of a bag in accordance with an additional alternate preferred embodiment of the present invention;

FIG. 13 is a partial perspective view of a bag in accordance with yet another alternate preferred embodiment of the present invention;

DETAILED DESCRIPTION OF THE PREFERRED EMBODIMENTS

Figure 1:
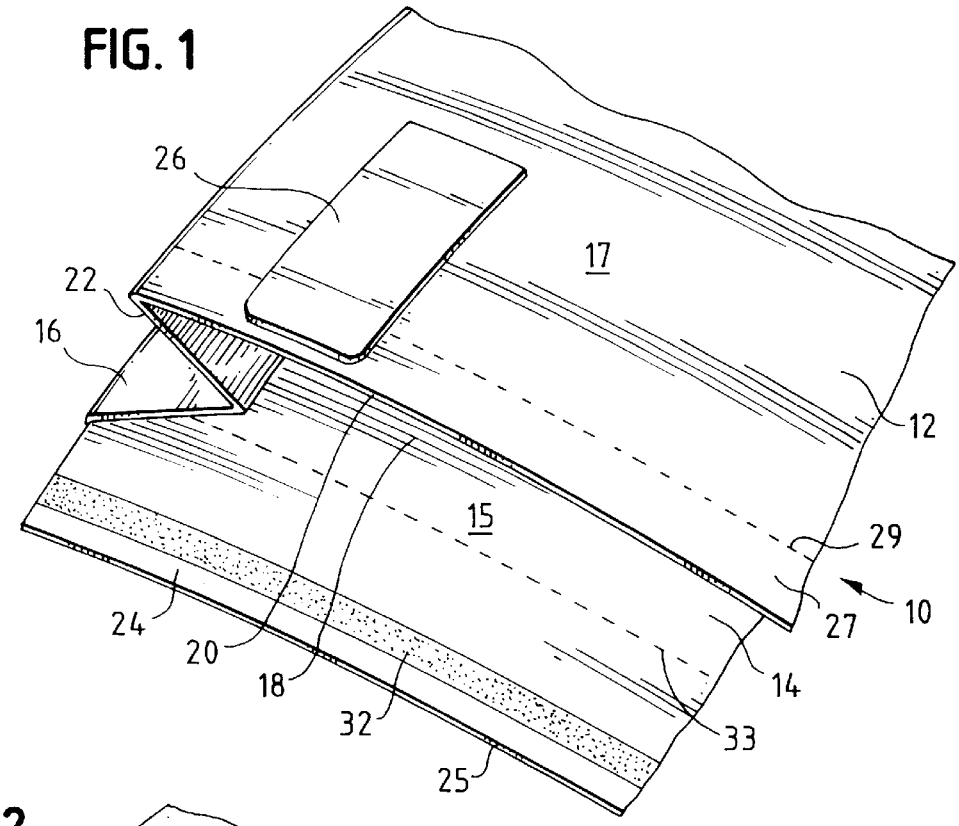
FIG. 1 is a partial perspective view of a bag according to the invention with the bag end in a pre-closed configuration.

With reference to FIG. 1, a bag 10 includes a front wall 12, a back wall 14 and first and second side walls (one shown as 16) defining an interior 15 and an exterior 17 of the bag 10. First and second side walls 16 preferably have a gusseted configuration, although the present invention is readily adaptable to flat-tube bags. Also, while described in terms of a single fold pinch bottom bag, one of ordinary skill in the art will appreciate that the present invention has application to double-fold bags and square end bags. The front wall 12, back wall 14 and first and second side walls 16 are each shown as single ply material; however, as will be appreciated from the discussion of additional preferred embodiments below, multi-layer laminate materials may also be used with the present invention.

With continuing reference to FIG. 1, bag 10 includes an open end 18, and the front wall 12 and first and second side walls 16 each include an end edge 20 and 22, respectively. A flap 24 is formed extending from the back wall 14 and beyond the end edges 20 and 22. A tab member 26 is secured to the front wall 12 on the exterior 17 of the bag 10, extending from the edge 20 along the front wall 12 substantially perpendicular to the edge 20. A second end of the bag 10 (not shown) may be pre-closed or remain open. In preferred embodiments, a bag may be manufactured with an enclosed end including an easy open feature in accordance with the present invention, and the second end is used for filling and is subsequently permanently sealed by the end-user. Of course, the end-user may use the open end 18 for filling, and then seal bag 10 in accordance with the present invention once filled.

Figure 2:
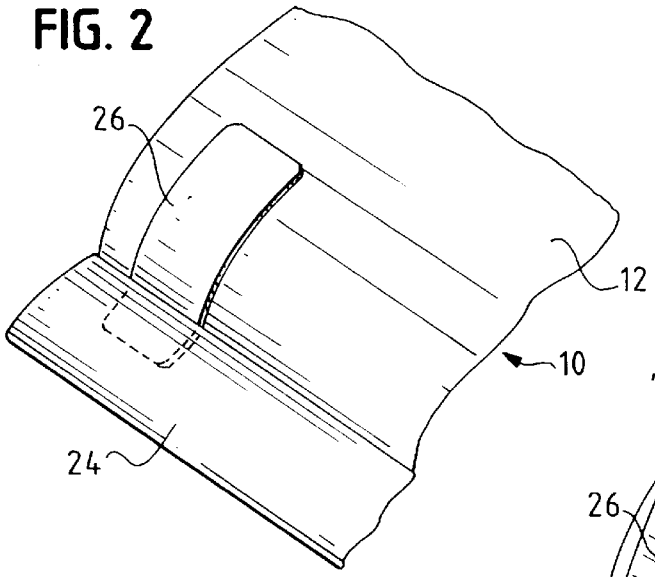
FIG. 2 illustrates the bag shown in FIG. 1 in a closed configuration.

The flap 24 folds along a line 28 to form an enclosed end (best seen in FIG. 2). Alternatively, the bag 10 may be closed by folding the flap 24 along the line 29, wherein a portion 27 of the front wall 12 is folded along the line 29 and retained beneath the flap 24. In the closed configuration, the flap 24 engages the front wall 12 and is secured thereto by an adhesive 32, which is applied in a substantially continuous pattern extending along the flap 24 between the first and second side walls 16 adjacent the edge 25. The tab member 26 extends outwardly along the front wall 12 from beneath the flap 24. The tab member 26 may be secured to the front wall 12 using a relatively strong adhesive, or the tab member 26 may be secured to the front wall 12 using an adhesive having high shear strength but low tensile strength. Such adhesives are frequently referred to as peel-free adhesives (an adhesive 35 for securing the tab 26 is illustrated in FIG. 4). Peel-free adhesives are advantageous in the present application in view of the fact the most of the stresses to which the bag 10 is exposed during folding and use of the bag 10 are in shear. Thus, the peel-free adhesive is very effective for retaining the tab member 26 to the front wall 12, while still permitting easy opening of the bag 10. Use of peel-free adhesive further offers the advantage of making the bag 10 resealable. The peel-free adhesive retains sufficient tackiness to re-adhere the tab member 26 to the front wall 12 with the application of modest force. In fact, the tab member 26 may be repeatedly removed and reattached. Therefore, once the bag 10 has been opened, it may be resealed by folding the open portion (31 in FIG. 3) of the flap 24, to which the tab member 26 was bonded when the bag 10 was first closed, and maintained in its folded closed position by the tab member 26 bonding to the front wall 12.

Figure 3:
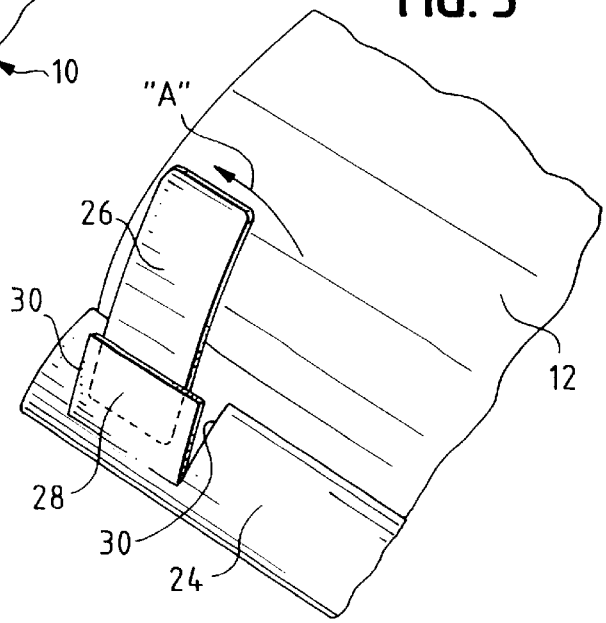
FIG. 3 illustrates the bag shown in FIG. 2 in a partially open configuration.
Figure 4:
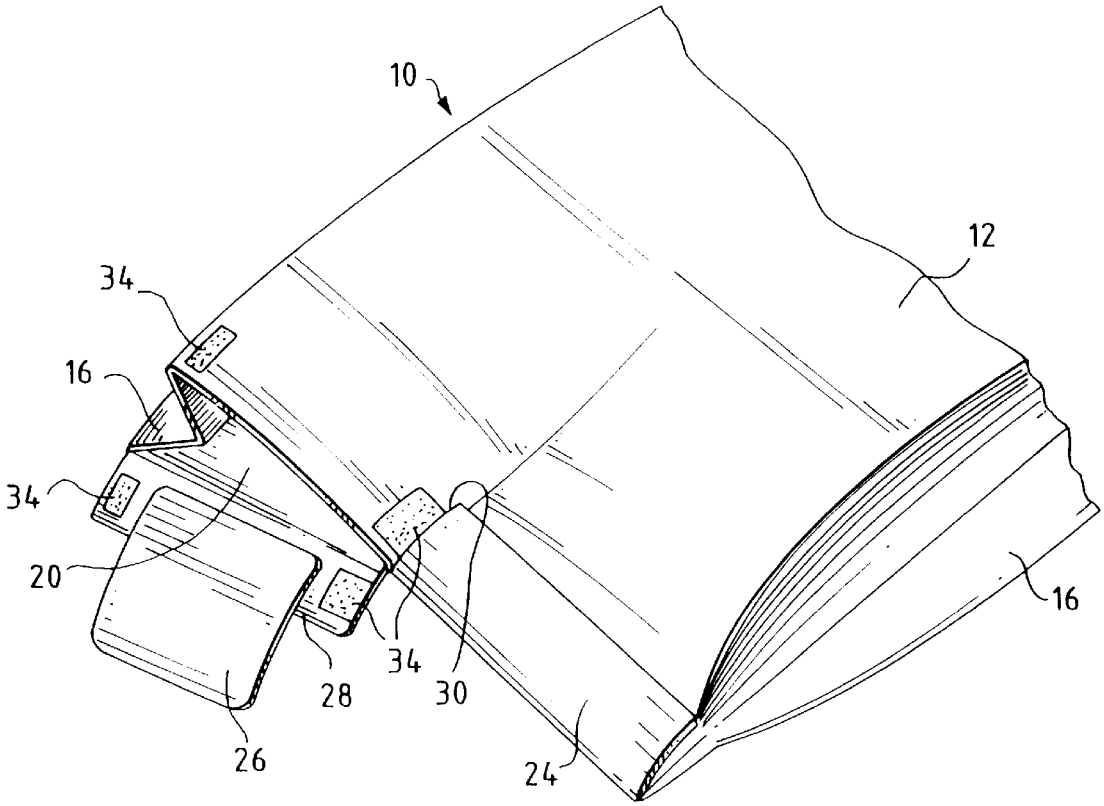
FIG. 4 illustrates the bag shown in FIG. 2 fully opened.

Referring to FIG. 3, the tab member 26 is pulled upwardly and forwardly as indicated generally by arrow "A." Pulling the tab member 26 in the direction of arrow "A" causes a tearing of the flap 24 along the tear lines 30 forming a tear away portion 31. The separation of the portion 28 from the flap 24 permits the opening of the bag 10 as shown in FIG. 4. The tab member 26 is retained to the portion 31 by the adhesive 32 and some delamination of the flap 24 and the front wall 12 occurs in the areas 34. The tab member 26 may be pulled from the front wall 12 by separation from its adhesive if a peel-free adhesive is used or as a result of delamination of an outer surface of the front wall 12 if a stronger adhesive is used.

The tab member 26 is shown positioned towards one of the first and second sides 16, which permits forming a pour spout as shown in FIG. 4. Of course, the tab member 26 may be positioned anywhere along the flap 24, such as at a center portion to form a center spout. The tab member 26 may further be positioned on an exterior of the bag, but within one of the gusset folds of the side walls 16. Moreover, it should be noted that the configuration of the tab member 26 shown in the Figures is representative of a possible tab configuration, and virtually any size and shape of tab members may be employed with the present invention.

The present invention has been found to provide easier opening by modifying how the flap 24 is secured to the front wall 12. With continued reference to FIG. 1, as noted adhesive the strip 32 is applied as a substantially continuous strip along the flap 24 and preferably closely adjacent to the edge 25. This ensures that when the flap 24 is folded and engaged with the front wall 12, the adhesive 32 does not bridge opening 18 which may cause the edge 20 to bond to the back wall 14 substantially impairing opening of the bag 10.

Figure 5:
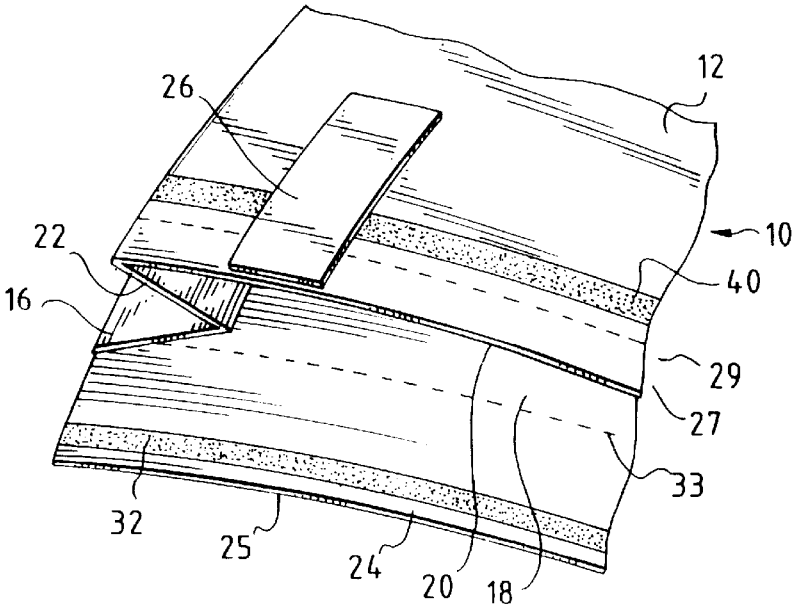
FIG. 5 illustrates the bag shown in FIG. 1 and further illustrates an alternate preferred glue pattern for effecting closure of the bag.

As shown in FIG. 5, an additional substantially continuous strip of adhesive 40 may be applied to the front wall 12, displaced from the edge 20. The tab member 26 is shown disposed over the adhesive 40, but it will be appreciated that tab member 26 may be first applied to the front wall 12 and the adhesive 40 applied over tab member 26. By positioning the adhesive 32 adjacent the edge 25 and the adhesive 40 displaced from the edge 20, upon sealing the bag 10 by the folding flap 24 into engagement with the front wall 12, neither the adhesive 32 nor the adhesive 40 bridges the opening 18. This "adhesive void" adjacent the opening 18 ensures that the bag 10 may be easily opened once the tab member 26 is used to tear open the portion 31 of the flap 24. In an alternative preferred embodiment, the portion 27 may be coated with silicon or similar material. In this embodiment, adhesive coming into contact with the coating disposed on the portion 27 will not substantially adhere effectively providing the desired adhesive void adjacent the opening 18.

For a bag to be opened such as shown in FIG. 4, the adhesive void may be limited to a local area adjacent the tab member 26. In this manner, the adhesive 32 and 40 may be applied in a pattern such that it is adjacent and does bridge the opening 18 away from the tab member 26 but forms the desired adhesive void in the vicinity of the tab member 26. Similarly, silicone or other coatings may be applied to the front wall 12 in local areas where opening of the bag 10 is desired. Still further, it is possible to coat the tab member 26 itself with silicone or a similar material to inhibit bonding of the flap 24 to the tab member 26, and hence the front wall 12, adjacent the opening 18 for forming the adhesive void.

Figure 6:
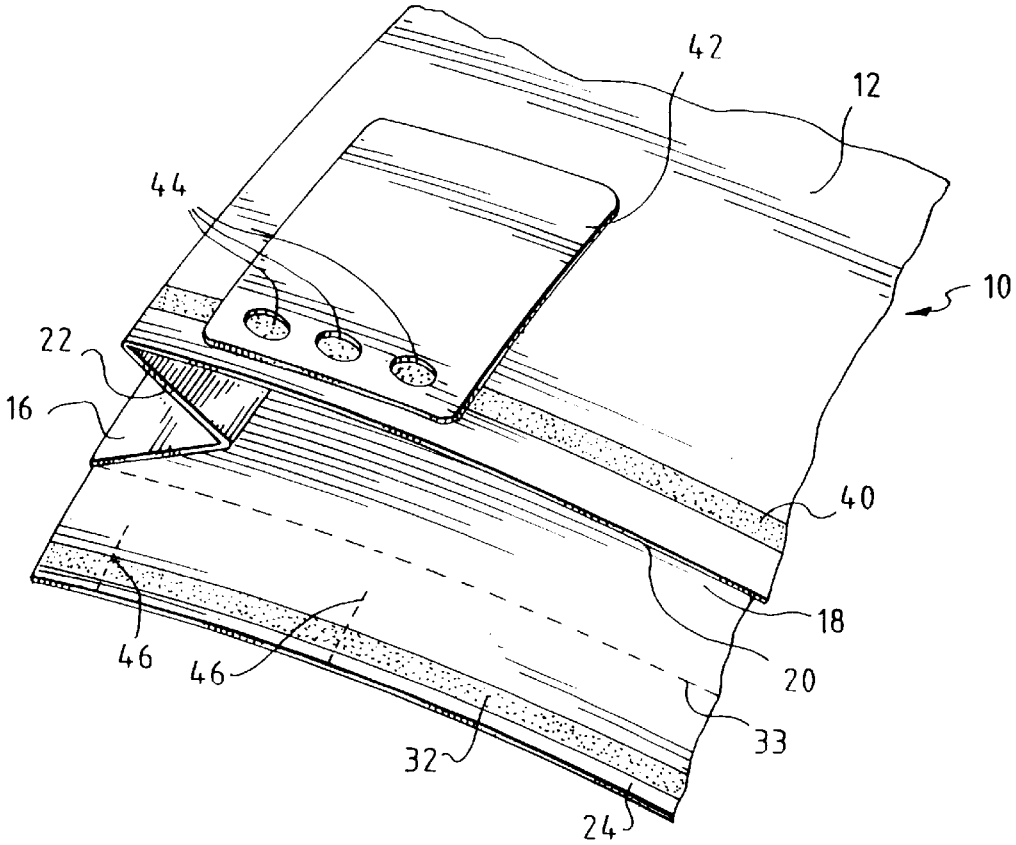
FIG. 6 illustrates the bag shown in FIG. 1 and further illustrates an alternate preferred tab member.

The adhesive void may not be acceptable in all application of the bag 10 because the adhesive void weakens the bag 10. The weakening of the bag 10 created by the adhesive void is desirable for facilitating opening the bag, but it may adversely effect using the bag in certain applications. As shown in FIG. 6, a tab member 42 is formed with a plurality of apertures 44. The apertures 44 permit bonding of the flap 24 to the front wall 12 in the area of the apertures 44 and through the tab member 42. Permitting bonding of the flap 24 to the front wall 12 through the apertures 44 substantially strengthens the bag 10 over providing an adhesive void for the entirety of the tab member 42. As a further enhancement, and to ensure tearing of the flap 24 in the region of the tab member 26, it may be desirable to provide tear lines, perforations or weakened areas 30 in flap 24 to ensure tearing adjacent the tab member 26.

Figure 7:
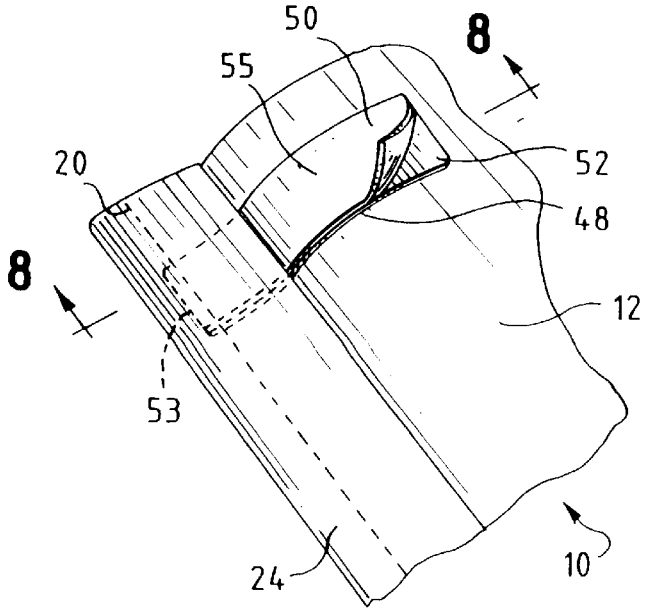
FIG. 7 illustrates the bag shown in FIG. 1 in a closed configuration and further illustrates another alternate preferred tab member.
Figure 8:
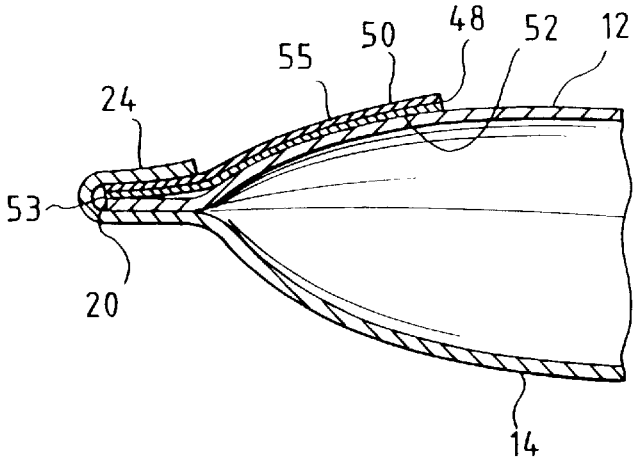
FIG. 8 is cross-section view taken along line 8—8 of FIG. 7.

Providing an adhesive void also may not be suitable for applications in which sifting leakage is a problem. The adhesive void provides a path through which fine particles may leak from the bag 10 and/or may provide an entry point for insects or contaminants. With reference to FIG. 7 and FIG. 8 a multi-ply tab member 49 including a first ply 50 and a second ply 52 is used in conjunction with the bag 10. Second ply 52 is substantially permanently bonded to the front wall 12. The first ply 50 is secured to the second ply 52 using a peel-free adhesive. The tab member 48 is secured to the front wall 12 with a portion 53 overlapping the edge 20 and a second portion 55 extending outwardly along the front wall 12 from beneath the flap 24. To open the bag 10, the first ply 50 is separated from the second ply 52 and pulled upwardly causing tearing of the flap 24 adjacent to the tab member 48. Because the second ply 52 is bonded to the front wall 12, the first ply 50 is bonded to the second ply 52 and the flap 24 is bonded to the first ply 50, substantially complete, sift resistant sealing of the bag 10 is provided. By providing the portion 53 overlapping the edge 20, an effective adhesive void is created adjacent the opening 18 facilitating opening of the bag 10.

Figure 9:
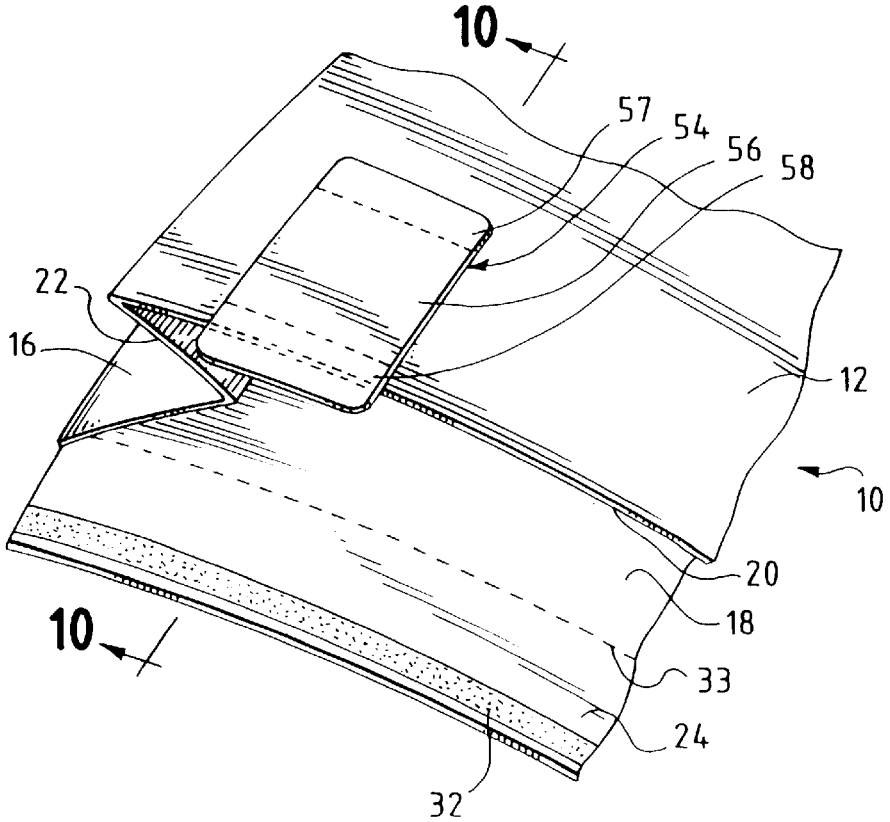
FIG. 9 illustrates the bag shown in FIG. 1 and further illustrates an alternate preferred tab member.
Figure 10:
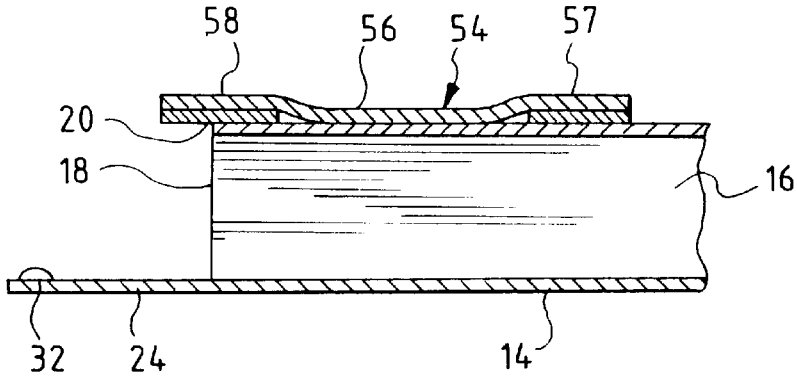
FIG. 10 is a cross-section view taken along line 10—10 of FIG. 9.

With reference to FIG. 9 and FIG. 10, a tab member 54, which also provides resistance to sift leakage, includes a body portion 56, a first tab portion 57 and a second tab portion 58. The tab member 54 is positioned to the front wall 12 such that the second tab portion 58 overlaps the edge 20. The second tab portion 58 is not bonded to the front wall 12, and in this manner the second tab portion 58 forms the adhesive void that facilitates opening of the bag 10. The body portion 56 extends along the front wall 12 from the end edge 20 and substantially perpendicular thereto and includes adhesive for securing the tab member 54 to the front wall 12. The first tab portion 57 is also unsecured to the front wall 12, and it permits easy grasping of the tab member 54 for opening the bag 10. Preferably, the tab member 54 is made from label stock having a label substrate with adhesive on one side and a release backing covering the adhesive. The release backing is preferably die cut or otherwise segmented such that a portion adjacent the tab portion 56 may be removed to expose the adhesive, while portions adjacent each of the first and second tab portions 57 and 58 remain secured to the substrate. The adhesive may then be advantageously used to secure the tab member 54 to the front wall 12 as described. The label stock may be further advantageously printed with opening instructions, coupon information and the like.

Figure 11:
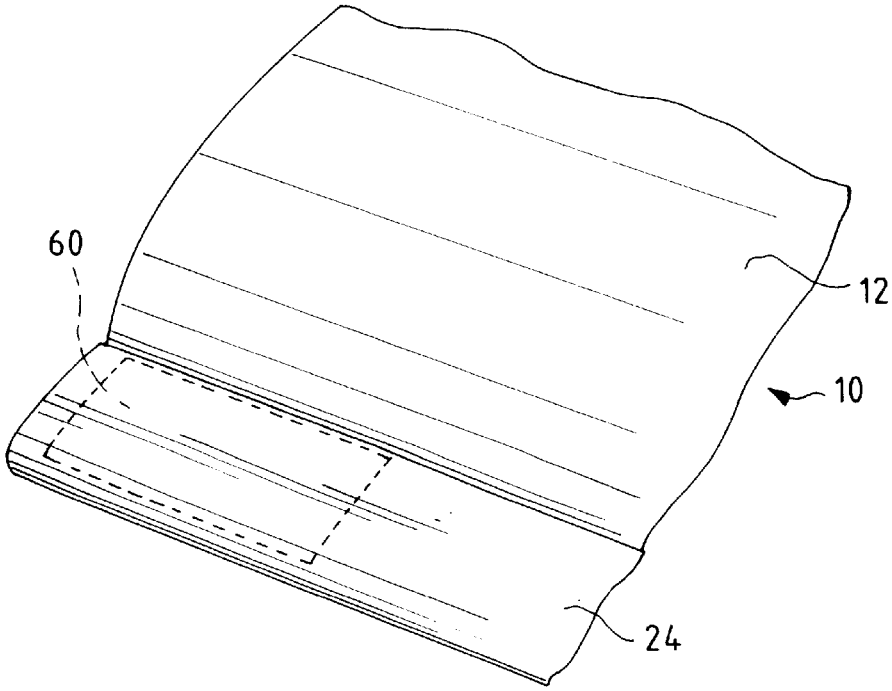
FIG. 11 is an illustration of the bag shown in FIG. 1 in a close configuration and further illustrates another alternate preferred tab member.

Referring to FIG. 11, still another alternate tab member 60 is shown. The tab member 60 is disposed substantially completely under the flap 24. This arrangement prevents inadvertent removal of the tab member and/or inadvertent opening of the bag 10. To open the bag 10 adapted with the tab member 60, a user places a finger or fingers under the flap 24 in the area of the tab 60 and lifts upwardly tearing the flap 24. The tab member 60 is preferably secured to the front wall 12 using a peel-free adhesive which allows easy separation of the tab member 60 from the front wall 12 allowing the user to insert a finger underneath the tab member 60 for opening the bag.

With reference now to FIG. 12, a bag 110 includes a front wall 112, a back wall 114 and first and second side walls (one shown as 116) defining an interior 115 and exterior 117 of the bag 110. Each of the front wall 112, the back wall 114 and the first and second side walls 116 are of a multi-ply construction, and the first and second side walls 116 further preferably have a gusseted configuration. The bag 110 includes an open end 118, and the front wall 112, and the first and second side walls 116 each include end edges 120 and 122, respectively. A flap 124 is formed extending from the back wall 114 and beyond the end edges 120 and 122. A tab member 126 is secured to the front wall 112 on the exterior of the bag 110, extending from the end edge 120.

The flap 124 folds along line 128 to form an enclosed end. In the closed configuration, the flap 124 engages the front wall 112 and is secured thereto by adhesive 132, which is applied in a substantially continuous pattern extending along a first lamination 142 and potentially each lamination of flap 124 between the first and second side walls 116. A substantially continuous pattern of the adhesive 140 is also applied to a lamination 146 of the front wall 112. Preferably the adhesive 140 is applied to an outermost lamination 146 of the front wall 112 displaced from the edge 120, leaving one or more of the inner laminations 148 and 150 adhesive free. Similarly, the adhesive 132 is preferably applied to outer most laminations, e.g., laminations 142 and 144, and adjacent the edge 125. As will be appreciated, this arrangement of the adhesive 132 and 140 assures adhesive does not bridge the opening 118 thereby providing an adhesive void that facilitates opening of the bag 110.

With reference to FIG. 13, a bag 210 includes a front wall 212, a back wall 214 and first and second side walls (one shown as 216). Each of the front wall 212, back wall 214 and first and second side walls 216 are shown of single ply construction, but may be of a multi-ply construction, and the first and second side walls 216 further preferably have a gusseted configuration. The bag 210 includes an open end 218, and the front wall 212, and the first and second side walls 216 each include an end edge 220 and 222, respectively. A flap 224 is formed extending from the back wall 214 and beyond the end edges 220 and 222. A tab member 226 is secured to the front wall 212 on the exterior of bag 210, extending from the end edge 220.

The flap 224 folds along line 228 to form an enclosed end. In the closed configuration, the flap 224 engages the front wall 212 and is secured thereto by the adhesive 232, which is applied in a substantially continuous pattern extending along the flap 224 between the first and second side wall 216 and the adjacent edge 225. The end edges 222 of the first and second side walls 216 have "long edges" or stepped plies 240 and 242. Adhesive 244 and 246 is applied to each of the stepped plies 240 and 242. Preferably, the stepped plies 240 and 242 extend sufficiently far along the flap 224 that during application of the adhesive 232, adhesive is also applied to each. In the closed configuration, the stepped plies 240 and 242 are bonded to the front wall 212 securing the gusset portion of the first and second side walls 216 to further strengthen the bag 210, while the tab member 226 provides for easy opening of the bag 210 in accordance with the present invention.

Figure 14:
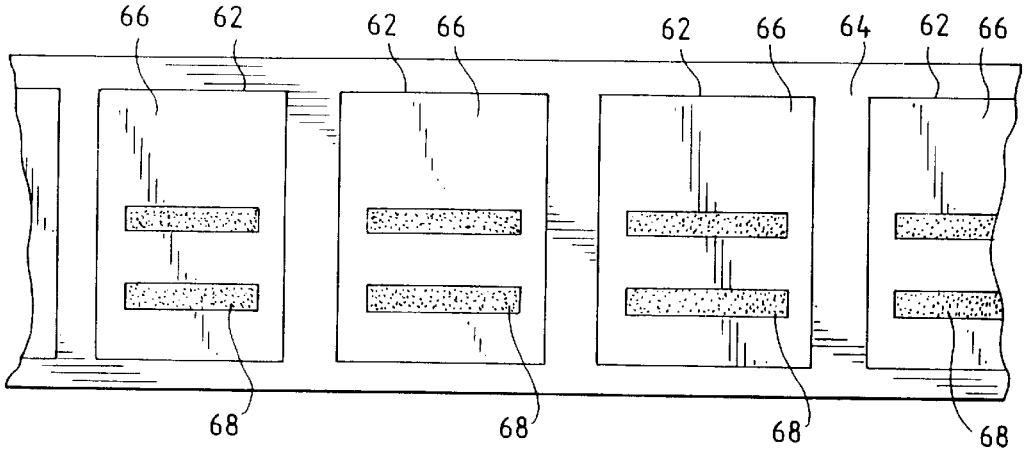
FIG. 14 is an illustration a plurality of tab members adhered to a release backing prior to application to a bag.
Figure 15:
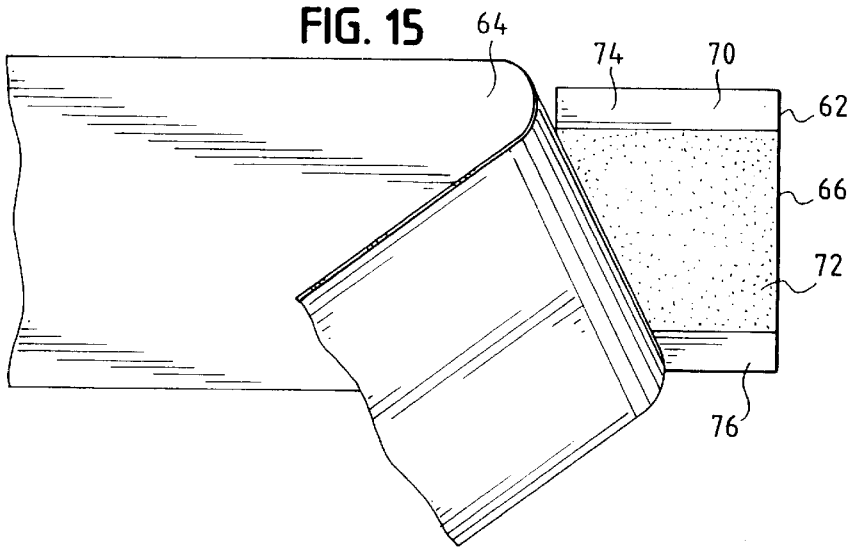
FIG. 15 is an illustration similar to FIG. 14, with a portion of the release backing pulled back to reveal the adhesive pattern formed on the back of the tab member.

Referring now to FIGS. 14 and 15, a plurality of tabs 62 are secured to a release backing 64. Each tab 62 is formed from a substrate 66, and the substrate 66 should have sufficient strength so as not to fail during opening of a bag. A suitable material for the substrate 66 is 2 mil mylar or similar material. It is also desirable to print messages, discount coupons or opening instructions 68 on a surface of the tab 62. The messages may be printed directly on the substrate 66 using a suitable ink for printing on mylar or plastic material. Alternatively, the substrate 66 may be formed as a laminate of paper and plastic, where the paper portion is exposed for printing.

On a back side 70 of the tab 62, best seen in FIG. 15 where a portion of the release backing 64 is shown pulled back to expose the back side 70, there is disposed adhesive 72. The adhesive 72 may be a peel-free adhesive as previously described, or a more aggressive adhesive. In either case it is important that adhesive be sufficiently aggressive so as to prevent creep of the tab 62 with respect to the bag at temperatures up to 150° Fahrenheit (F.).

The adhesive 72 is disposed on a center portion of the back side 70 leaving the end portions 74 and 76 adhesive free. The end portion 74 provides for forming the previously described adhesive void in accordance with the present invention for facilitating opening of a bag. The end portion 76 provides a portion of tab member that may be easily grasped for opening the bag.

Figure 16:
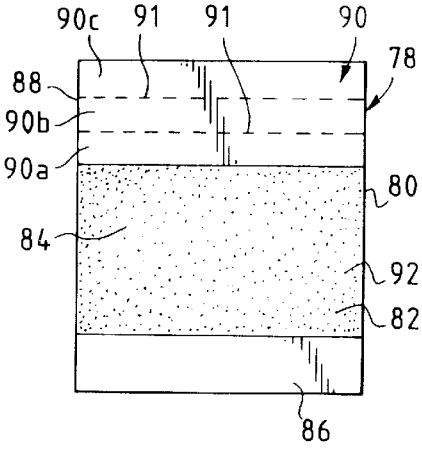
FIG. 16 is a rear view of a tab member in accordance with an alternate preferred embodiment of the invention.
Figure 17:
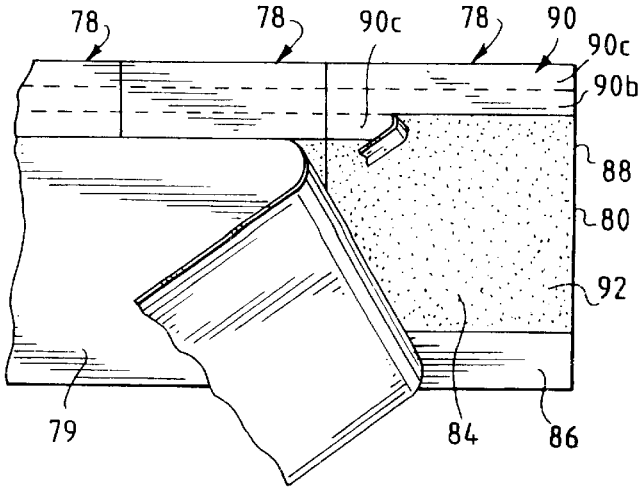
FIG. 17 is a rear view of a plurality of tab members as shown in FIG. 16 adhered to a release backing prior to application to a bag.

Referring now to FIG. 16, a tab 78 is formed from a substrate 80. Preferably, a plurality of tabs 78 are retained on a release backing 79 as shown in FIG. 17 from which they may be removed and attached to a bag. The substrate 80 is preferably mylar or similar plastic material, and may be a laminate material. Adhesive 82 is disposed on a surface 84 of the tab member 78. An end portion 86 is maintained adhesive free. A first portion of the adhesive 82 at the end 88 is covered by a layer 90 of release the backing material 79 and a second portion 92 of the adhesive 82 remains exposed. The layer 90 is formed with a plurality of perforations 91, permitting individual segments, respectively 90*a*, 90*b* and 90*c*, to be individually removed, and segment 90*a* is shown partially displaced from the tab member 78 in FIG. 17. In an alternate preferred embodiment, segments 90*a*, 90*b* and 90*c* may be die cut and therefore completed separated from one another. The adhesive 82 secures the tab 78 to a bag for forming an easy opening feature as described in accordance with the present invention with end portion 86 forming the preferred void between a closing flap and outer wall of the bag. The tab 78 further permits reclosing of the bag. Again, the adhesive 82 may be a peel-free adhesive or a more aggressive adhesive. The exposed portion 92 may be used, if it retains sufficient tackiness, to resecure the tab 78 to the bag and to thereby maintain the bag in a closed position. When the exposed portion 92 loses sufficient tackiness for reclosing the bag, a segment 90*a*–90*c* may be removed exposing a fresh portion of the adhesive 82. Additionally, while in place, the layer 90 leaves a portion of the tab 78 free to be grasped for opening the bag. It will be appreciated, however, that the adhesive 92 may not necessarily extend completely to the end 88 to provide a free portion of the tab 78 available for grasping when all of the segments 90*a*–90*c* have been removed.

Figure 18:
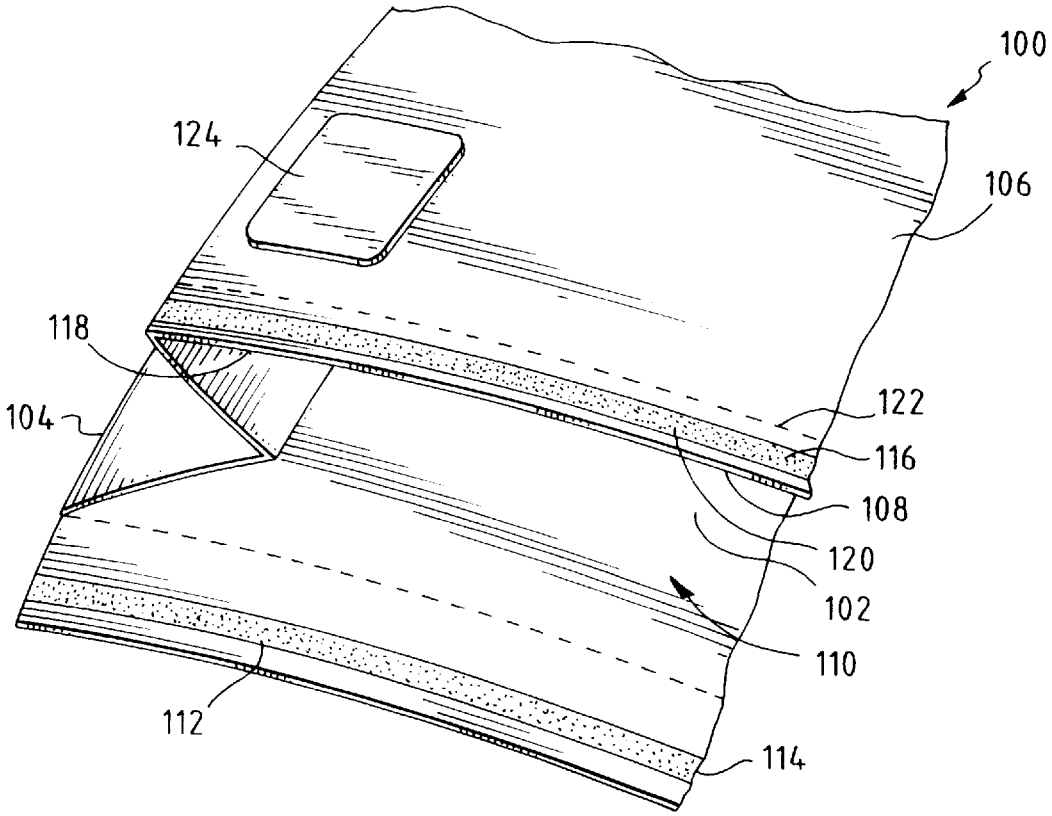
FIG. 18 is a partial perspective view of a bag in accordance with an additional alternate preferred embodiment of the invention.
Figure 19:
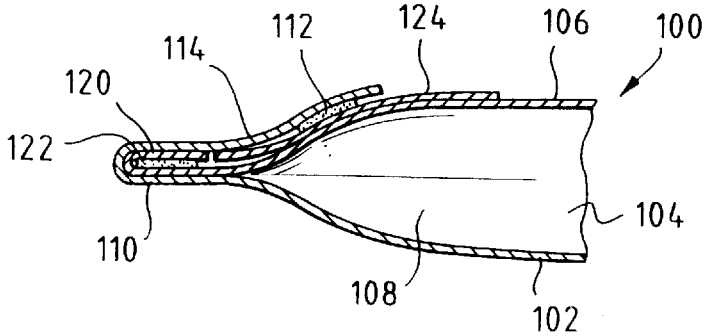
FIG. 19 is a side cross-section of the bag shown in FIG. 18 in a closed configuration.

With reference now to FIGS. 18 and 19, a bag 100 includes a back wall 102, first and second gusseted side walls (only one of which is shown as 104) and a front wall 106 that define and interior portion 108 of the bag 100 and an opening end 110 of the bag 100. To close the bag 100, adhesive 112 is applied to a flap 114 formed with the back wall 102 and adhesive 116 may be applied to the front wall 106 near an end edge 118 of the front wall 106. The flap 114 and a portion 120 of the front wall 106 are folded over along a fold line 122 and secured to the front wall 106 to close the bag 100, best seen in FIG. 19.

Bag 100 also includes a tab 124 that facilitates opening of the bag 100. The tab 124 may be secured the front wall 106 by adhesive. The adhesive may be a peel-free adhesive as described above. The tab 124 may further include a backing (not shown) that is bonded to the front wall 106 with the tab 124 being secured to the backing by a releasable adhesive that further permits the tab 124 to be resecured to the backing.

As seen in FIG. 19, with the bag closed the tab 124 extends along the front wall 106 from the end edge 118 away from the opening end 100 and outwardly from beneath the flap 114. The folded portion 120 of the front wall 106 ensures an adhesive void exists adjacent the opening end 110 to facilitate opening of the bag 100.

Figure 20A:
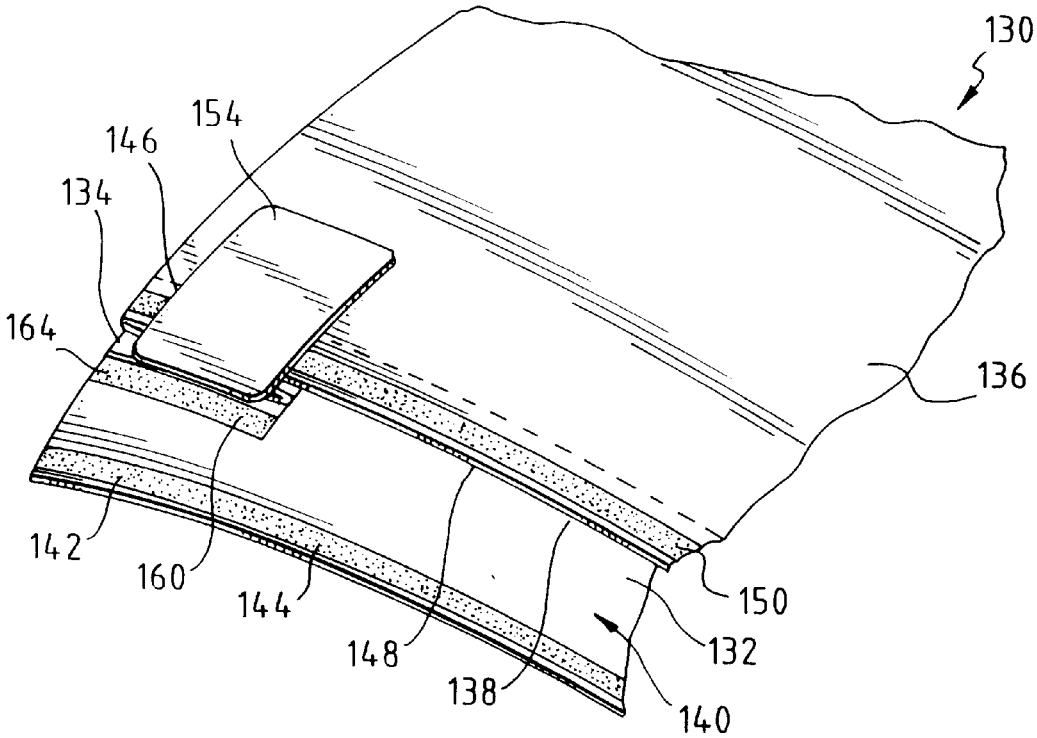
FIGS. 20A–20C are partial perspective views of a bag in accordance with additional alternate preferred embodiments of the invention illustrating alternate preferred locations for the tab.
Figure 20B:
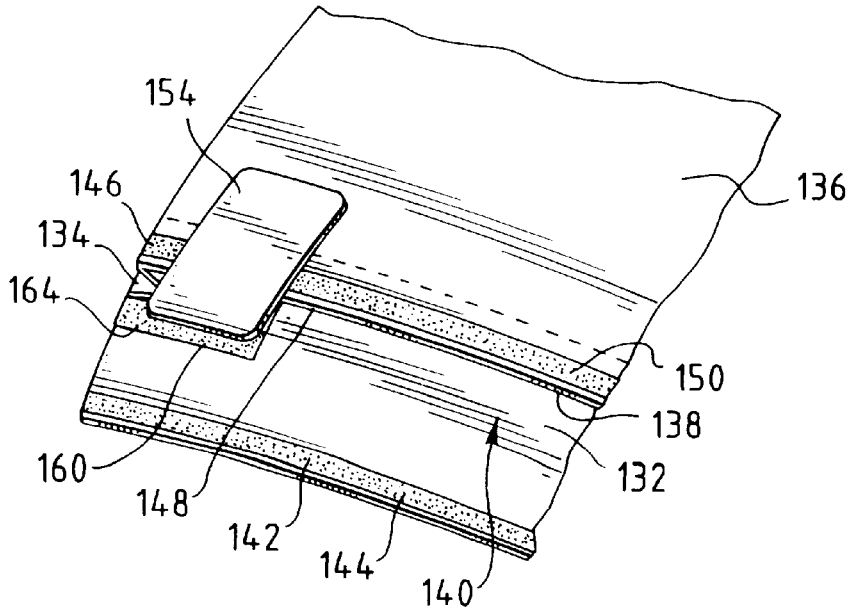
Figure 20C:
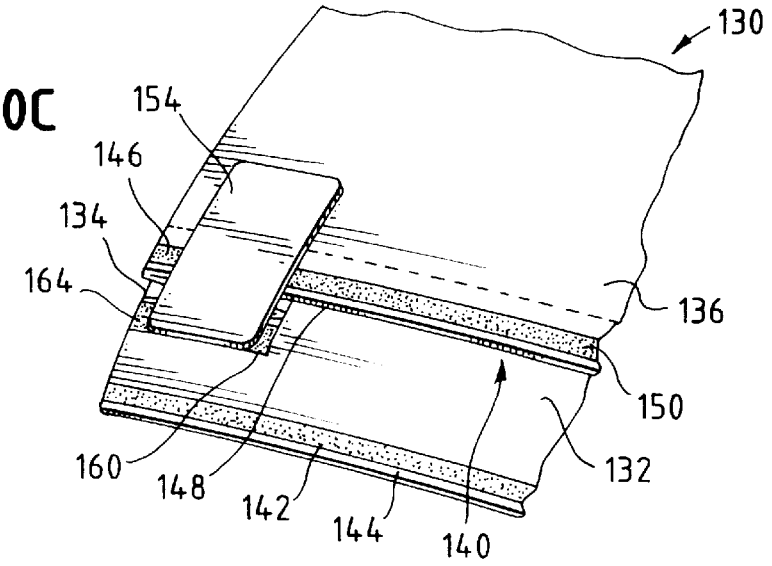

Referring now to FIGS. 20A–20C, several alternate arrangements of a bag 130 are shown. Each bag 130 includes a back wall 102, first and second gusseted side walls (only one of which is shown as 134) and a front wall 106 that together define an interior portion 138 of the bag 130 and an opening end 140 of the bag 130. To close the bag 130, adhesive 142 is applied to a flap 144 formed with the back wall 132 and adhesive 146 may be applied to the front wall 136 near an end edge 148 of the front wall 136. The flap 144 and a portion 150 of the front wall 136 are folded over along a fold line 152 and secured to the front wall 136 to close the bag 130.

To ensure the gusseted side wall 134 remains secured, a flap 160 is formed extending from an end edge 162 of the side wall 134. Adhesive 164 may be applied to the flap 160, and when the bag 130 is closed, the flap 160 is secured to the front wall 136 locking the side wall 134 gusset.

Bag 130 also includes a tab 154 that facilitates opening of the bag 130. The tab 154 may be secured to the front wall 136 by adhesive. The adhesive may be a peel-free adhesive as described above. The tab 154 may further include a backing, such as described above, that is bonded to the front wall 136 with the tab 154 being secured to the backing by a releasable adhesive that further permits the tab 154 to be resecured to the backing. FIG. 20A illustrates a first location on the front wall 136 for the tab 154. The tab 154 extends from the end edge 148 of the front wall 136 leaving the tab 154 substantially uncovered. This arrangement ensures that the side wall 134 is firmly locked upon closing of the bag 130.

Figure 21:
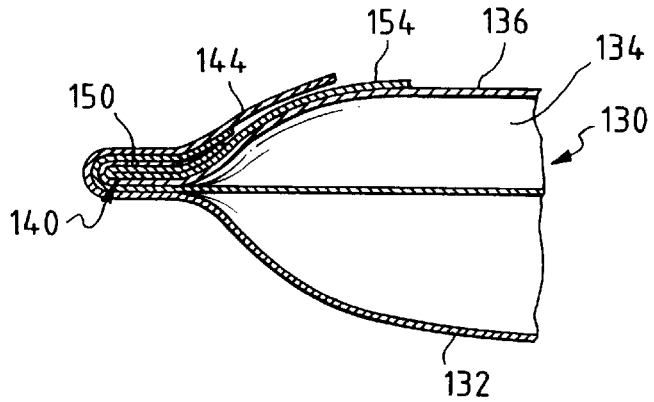
FIG. 21 is a side cross-section of the bag shown in FIG. 20B in a closed configuration.

Referring to FIG. 20B and FIG. 21, a second location for the tab 154 is shown. In the second location, the tab 154 is arranged to extend beyond the end edge 148 partially covering the flap 160. When the bag 130 is closed, the uncovered portion of the flap 160 is secured to the front wall 136 securing the side wall 134 gusset. Because the entirety of the flap 160 is not secured to the front wall 136 when the bag is initially closed and sealed, the side wall 104 gusset is more easily released upon opening of the bag 130.

Referring to FIG. 20C, a third location for the tab 154 is shown. In the third location, the tab 154 is arranged to extend beyond the end edge 148 and substantially completely covering the flap 160. When the bag 130 is closed, the tab 160 is not secured to the front wall 136, and the side wall 104 gusset is not locked. This arrangement permits the side wall 104 gusset to be freely released upon opening of the bag 130.

One of ordinary skill in the art will appreciate that the selection of one of many possible locations for the tab 154 may be selected depending on the particular bag application and how securely the side wall 134 gusset is to be secured. Likewise, one of skill in the art will appreciate that location of the opening tab may be generally positioned with respect to the opening end of the bag to facilitate easy opening of the bag.

Figure 22:
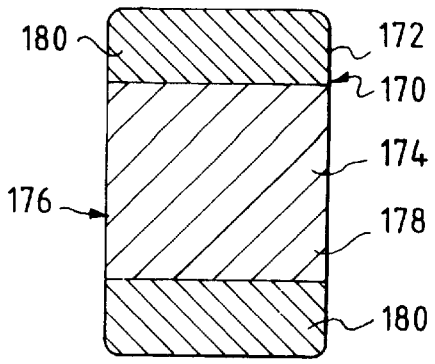
FIG. 22 is a rear view of a tab member in accordance with an additional alternate preferred embodiment of the invention.

FIG. 22 illustrates a tab 170 that may be used with virtually any of the bags described herein. The tab 170 includes a durable substrate 172 having a front surface (not shown) and a back surface 174. A pattern 176 of adhesive is applied to the back surface 174. The pattern 176 may include a first adhesive portion 178 and a second adhesive portion 180. The first adhesive portion 178 may be a permanent strong adhesive for securing the tab to the bag. The second adhesive portion 180 may be a peel-free adhesive that permits repeated opening and closing of the bag. The second adhesive portion 180 may also be an adhesive free portion or a "killed" portion of the permanent strong adhesive to leave a portion of the tab unsecured from the bag so that it may be easily grasped for opening the bag. The second adhesive portion 180 may not be adhesive, but may instead be another mechanism for providing repeated opening and closing of the bag. For example, VELCRO brand inter-locking fastener material, DUAL-LOCK brand inter-locking fastener material or similar material may be used to permit reclosing of the bag.

The invention has been described in terms of several preferred embodiments directed to pinch bottom bags. It will be appreciated that the invention may be adapted to other bag types apart from pinch bottom bags. The invention may also be incorporated into closed bag ends as provided from the manufacturing facility, and/or may be incorporated into the bag by the end-user after filling. Still further the tabs may be printed to provide opening instructions, discount coupons, and the like. Moreover, the broad aspects of the invention have application to single-ply as well as multi-ply bag constructions. The above-described preferred embodiments are intended to be illustrative of the broad scope of the invention, which is defined by the sub-joined claims.

I claim:

1. A recloseable easy-open bag comprising a front wall, a back wall, first and second side walls interconnecting the front wall and the back wall, the walls defining an interior and an exterior of the bag, and an enclosed end;

the enclosed end having a flap formed integral with the back wall and further being foldable over an open edge of the front wall and engaging the front wall and secured thereto;

a tab detachably secured to the front wall on an exterior surface thereof by an adhesive, the tab extending from the open edge and being disposed between the flap and the front wall;

the adhesive being a peel-free adhesive arranged for resecuring the tab to the front wall for reclosing an opened portion of the flap;

wherein the tab further comprises a portion unsecured to the front wall at an end opposite the open edge, the unsecured portion comprising a release backing disposed over a portion of the adhesive and wherein the release backing comprises a plurality of release backing segments.

2. The recloseable easy-open bag of claim 1, wherein the tab further comprises printing disposed on an exposed surface thereof.

3. The recloseable easy-open bag of claim 1, wherein the tab comprises a plastic substrate.

4. The recloseable easy-open bag of claim 3, wherein the substrate comprises a laminate.

5. A recloseable bag comprising a front wall, a back wall, first and second side walls interconnecting the front wall and the back wall, the walls defining an interior and an exterior of the bag, and an enclosed end;

the enclosed end having a flap formed intergral with the back wall and further being foldable over an open edge of the front wall and engaging the front wall and secured thereto;

a tab detachably secured to the front wall on an exterior surface thereof by an adhesive, the tab extending from the open edge and being disposed between the flap and the front wall;

a segmented release backing covering a portion of the adhesive for maintaining a portion of the tab opposite the open end unsecured from the front wall.

6. The recloseable bag of claim 5, wherein the segmented release backing comprises a plurality of release backing segments.

7. The recloseable bag of claim 5, wherein the adhesive is disposed on the tab.

8. The recloseable bag of claim 5, the tab further comprising printing disposed on an exposed surface thereof.

9. The recloseable bag of claim 5, wherein the tab comprises a plastic substrate.

10. The recloseable bag of claim 5, wherein the tab comprises a laminate.

* * * * *